US009681227B2

(12) United States Patent
Ronig et al.

(10) Patent No.: US 9,681,227 B2
(45) Date of Patent: Jun. 13, 2017

(54) AUDIO OUTPUT DEVICE AND METHOD FOR DETERMINING A SPEAKER CONE EXCURSION

(71) Applicant: INTEL IP CORPORATION, Santa Clara, CA (US)

(72) Inventors: Richard Ronig, Oberhausen (DE); Christian Kranz, Ratingen (DE); Markus Hammes, Dinslaken (DE)

(73) Assignee: Intel IP Corporation, Santa Clara, CA (US)

( * ) Notice: Subject to any disclaimer, the term of this patent is extended or adjusted under 35 U.S.C. 154(b) by 167 days.

(21) Appl. No.: 14/593,843

(22) Filed: Jan. 9, 2015

(65) Prior Publication Data

US 2015/0237443 A1 Aug. 20, 2015

(30) Foreign Application Priority Data

Feb. 14, 2014 (DE) ..... 10 2014 101 881

(51) Int. Cl.
*H04R 3/00* (2006.01)
*H04R 29/00* (2006.01)

(52) U.S. Cl.
CPC ..... *H04R 3/007* (2013.01); *H04R 3/002* (2013.01); *H04R 29/003* (2013.01); *H04R 2499/11* (2013.01)

(58) Field of Classification Search
CPC ..... H04R 3/007; H04R 3/002; H04R 29/003; H04R 2499/11
USPC ..... 381/55, 59
See application file for complete search history.

(56) References Cited

U.S. PATENT DOCUMENTS

| | | | |
|---|---|---|---|
| 6,931,135 | B1 | 8/2005 | Kohut |
| 2007/0140058 | A1 | 6/2007 | McIntosh et al. |
| 2009/0190789 | A1 | 7/2009 | Liitola et al. |
| 2012/0249125 | A1 | 10/2012 | Yamkovoy et al. |

(Continued)

FOREIGN PATENT DOCUMENTS

| | | | |
|---|---|---|---|
| EP | 0 508 392 | A2 | 10/1992 |
| WO | WO-2012009670 | A2 | 1/2012 |
| WO | WO-2013182901 | A1 | 12/2013 |

OTHER PUBLICATIONS

Office Action from foreign counterpart German Patent Application No. 102014101881.8, mailed Jul. 7, 2014, 12 pages.

(Continued)

*Primary Examiner* — David Ton
(74) *Attorney, Agent, or Firm* — Blakely, Sokoloff, Taylor & Zafman LLP

(57) ABSTRACT

An audio output device is described comprising a speaker; an audio output circuit configured to receive a first audio signal and configured to supply the first audio signal and a second audio signal to the speaker, wherein the second audio signal comprises a higher frequency than the first audio signal; a microphone configured to receive an acoustic signal from the speaker in response to the first audio signal and the second audio signal and to convert the acoustic signal into a received audio signal and a determiner configured to determine a phase of a frequency component of the received audio signal corresponding to the second audio signal and to determine an excursion of the speaker by the first audio signal based on the phase.

19 Claims, 4 Drawing Sheets

(56) References Cited

U.S. PATENT DOCUMENTS

2014/0241536 A1* 8/2014 Adams ..... H04R 29/003
381/59

OTHER PUBLICATIONS

Beers, et al., "Frequency-Modulation Distortion in Loudspeakers", Proceedings of the I.R.E., Issue 4, Apr. 1943, pp. 132-138.
Klippel, W., "Assessment of Voice Coil Peak Displacement Xmax", 112th Convention of the Audio Engineering Society AES, May 2002, pp. 1-15.

* cited by examiner

AUDIO OUTPUT DEVICE AND METHOD FOR DETERMINING A SPEAKER CONE EXCURSION

TECHNICAL FIELD

Embodiments described herein generally relate to audio output devices and methods for determining a speaker cone excursion.

BACKGROUND

Electrodynamical loudspeakers are prone to damage by overly large excursion of the voice coil and the cone. Typical failures are caused by the voice coil hitting the back plate or the suspension being torn due to excessive forward force. This may be addressed by limiting the excursion of the loudspeaker. For this, approaches to measure the excursion of a loudspeaker are desirable.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various aspects are described with reference to the following drawings, in which.

DESCRIPTION OF EMBODIMENTS

Figure 1:
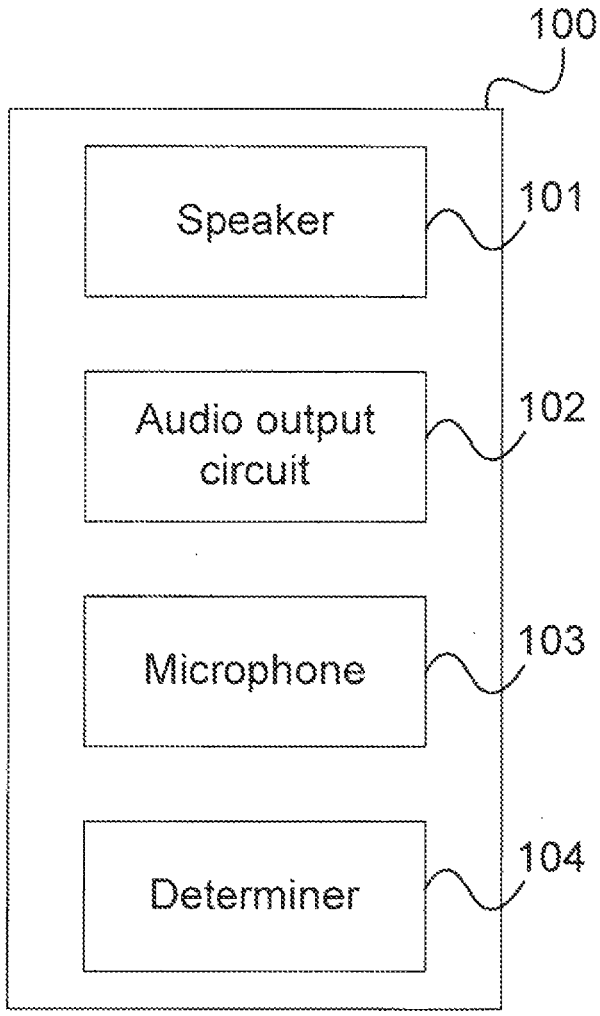
FIG. 1 shows an audio output device

The following detailed description refers to the accompanying drawings that show, by way of illustration, specific details and aspects of this disclosure in which the invention may be practiced. Other aspects may be utilized and structural, logical, and electrical changes may be made without departing from the scope of the invention. The various aspects of this disclosure are not necessarily mutually exclusive, as some aspects of this disclosure can be combined with one or more other aspects of this disclosure to form new aspects.

In today's mobile devices with the capability to output audio, e.g. communication devices such as mobile phones, very small loudspeakers are typically used. These are called micro speakers. Due to their limited performance, these loudspeakers are often operated close to the boundary of their safe operating region, which makes them especially vulnerable to damage by large voice coil excursion. Excursion herein refers to how far the cone of a speaker linearly travels from its resting position.

To mitigate this problem, loudspeaker protection schemes may be employed.

For example, a loudspeaker protection scheme adapts the loudspeaker input power dependent on the current excursion maximum.

For this, voice coil excursion may for example be measured by measuring the cone position directly using a laser. Although this is typically very accurate it is undesirable to be commercially employed for products such as mobile communication devices, e.g., mobile phones, due to its expensive components. Additionally, size constraints in mobile devices impede the use of additional bulky hardware.

Further, cone acceleration can be measured by means of an accelerometer. However, apart from the difficulty of reconstructing the cone position from its acceleration (for which for example two cascaded integrators are used), the use of an accelerometer deteriorates loudspeaker performance (sensitivity, impulse response) due to the increased mass of the moving mechanical system. Additionally, robustness is typically an issue on account of the fixation of the accelerometer to the cone (e.g. by means of glue). Moreover, an accelerometer is also a relatively expensive component.

Cone velocity can also be measured using a secondary magnetic system with an additional winding integrated into the loudspeaker. A cone velocity dependent current is then induced into the second winding. However, due to the necessity of a second winding this approach also increases the complexity and cost of the loudspeaker.

In the following, approaches are described for measuring the excursion of a loudspeaker (e.g. the excursion of the voice coil and the cone of the loudspeaker) which may for example be especially suitable for mobile communication devices such as mobile phones since they may make use of the hardware components that are typically present within mobile communication devices (such as microphone, microphone interface and digital signal processing block) and thus do not generate extra cost for hardware.

FIG. 1 shows an audio output device 100.

The audio output device 100 includes a speaker 101 and an audio output circuit 102 configured to receive a first audio signal (e.g. to be output) and configured to supply the first audio signal and a second audio signal to the speaker 101, wherein the second audio signal has a higher frequency than the first audio signal.

The audio output device 100 further comprises a microphone 103 configured to receive an acoustic signal from the speaker 101 in response to the first audio signal and the second audio signal and to convert the acoustic signal into a received audio signal.

Further, the audio output device 100 comprises a determiner 104 configured to determine a phase of a frequency component of the received audio signal corresponding to the second audio signal and to determine an excursion of the speaker 101 by the first audio signal based on the phase.

In other words, a second audio signal is superimposed on a first audio signal which is for example the useful audio signal that is to be output by the speaker, e.g. corresponds to the audio output of some application running on the audio output device. The audio output device receives the acoustic signal output by the speaker when supplied with the first audio signal superimposed with the second audio signal and determines the phase of the frequency component of the received acoustic signal corresponding to the second audio signal (i.e. the frequency component having the same frequency as the second audio signal). Based on this phase, the audio output device determines the excursion of the loudspeaker caused by the first audio signal. The excursion of the loudspeaker can be understood as the excursion of the cone of the loudspeaker.

The second audio signal may for example be for example be provided by a signal generator which may for example be part of the audio output device.

This can be seen as exploiting the acoustic Doppler effect. For example, it is assumed that a loudspeaker is excited by an (electrical) audio signal which is composed of both a low frequency and a high frequency component. Due to the low frequency component of the resulting cone excursion, the location at which the loudspeaker generates an acoustic signal (in response to the high frequency component of the electrical signal) varies over time. Hence, for an observer located on the axis of cone and voice coil movement of the loudspeaker, the generated acoustic signal is phase modulated (this phenomenon is also referred to as Doppler effect).

It should be noted that the first (lower frequency) audio signal is also phase-modulated by the second (higher frequency) audio signal. However, this phase modulation is typically very small.

Accordingly, by superposition of a high frequency pilot tone onto a wanted audio signal, the speaker generates an acoustic representation of the pilot tone which is phase-modulated by the wanted signal. For example, a speaker protection system is provided which picks up the acoustic signal using a microphone and microphone interface circuitry to generate a received (electrical) audio signal. The system may isolate the received pilot tone from the received audio signal and demodulate it to yield the speaker cone excursion.

Under "audio output device" any (e.g. electronic) device may be understood with the capability to output audio, e.g. mobile phones, tablet computers, laptop computers etc. The term "audio signal" refers, unless otherwise specified, to an electrical audio signal, i.e. an electrical representation of an audio signal while the term "acoustic signal" refers to the actual acoustic wave transmitted via an acoustic channel (typically via air).

The determiner may for example be configured to determine the excursion based on the phase by comparing the phase with a reference phase when the first audio signal is equal to a predetermined signal, e.g. a constant tone with one or more constant predetermined frequency components or e.g. zero.

The audio output device may further comprise a controller configured to control an input power of the speaker, e.g. for one or more certain frequency bands, based on the excursion.

Figure 2:
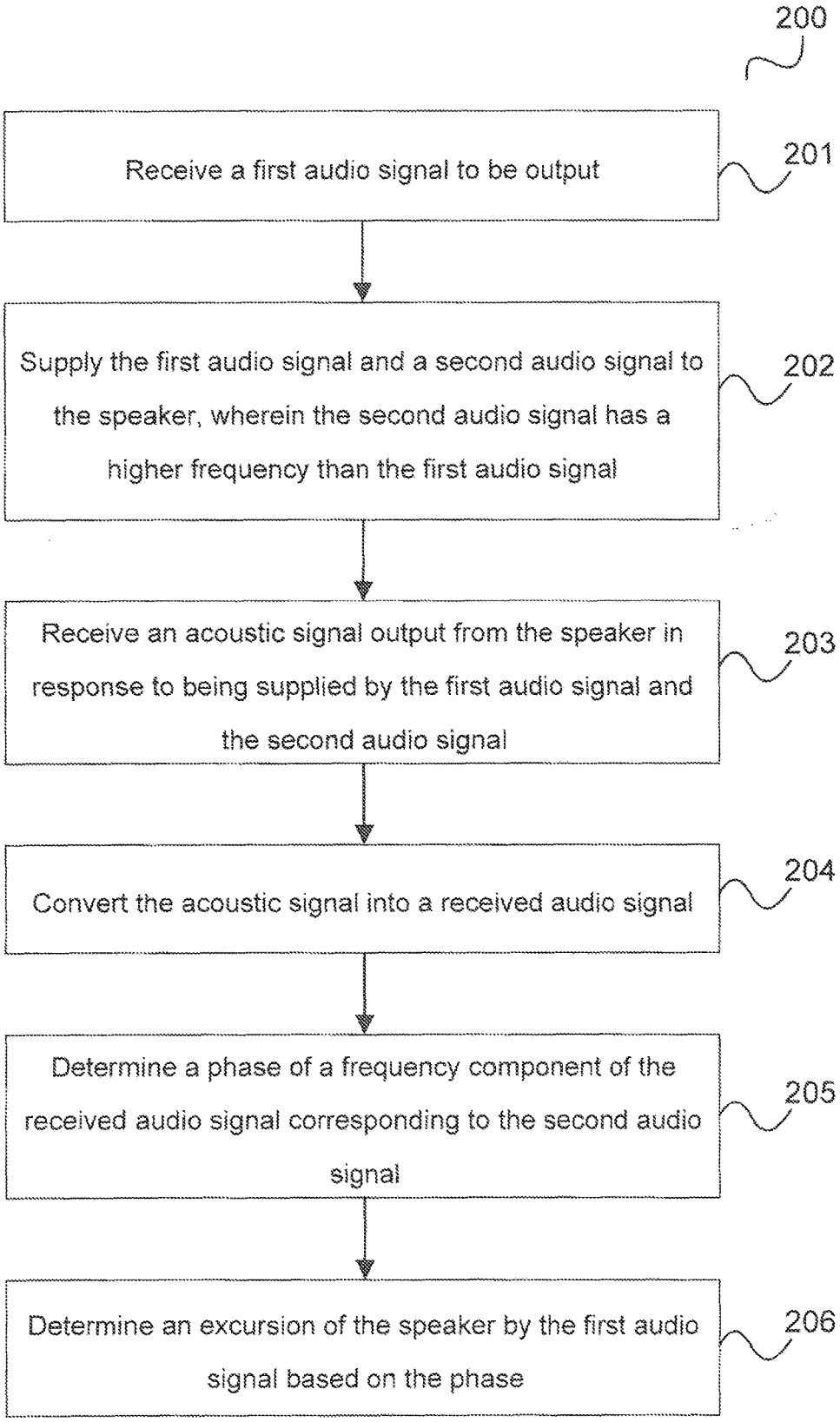
FIG. 2 shows a flow diagram illustrating a method for determining a speaker cone excursion.

The audio output device 100 for example carries out a method as illustrated in FIG. 2.

FIG. 2 shows a flow diagram 200 of a method for determining a speaker cone excursion.

The flow diagram 200 illustrates a method for determining a speaker cone excursion, for example carried out by an audio output device.

In 201, a component of the audio output device receives a first audio signal (e.g. to be output), e.g. from another component of the audio output device.

In 202, the component supplies the first audio signal and a second audio signal to a speaker, wherein the second audio signal has a higher frequency than the first audio signal.

In 203, the audio output device receives an acoustic signal from the speaker in response to the first audio signal and the second audio signal.

In 204, the audio output device converts the acoustic signal into a received audio signal.

In 205, the audio output device determines a phase of a frequency component of the received audio signal corresponding to the second audio signal.

In 206, the audio output device determines an excursion of the speaker by the first audio signal based on the phase.

The following examples pertain to further embodiments.

Example 1 is an audio output device as described with reference to FIG. 1.

In Example 2, the subject matter of Example 1 may further include the determiner comprising a phase modulation demodulator configured to determine the phase of the frequency component of the received audio signal corresponding to the second audio signal.

In Example 3, the subject matter of any one of Examples 1-2 may further include the determiner determining the excursion based on the phase by comparing the phase with a reference phase when the first audio signal is equal to a predetermined signal.

In Example 4, the subject matter of any one of Examples 1-3 may further include the determiner comprising a filter configured to filter the received audio signal to extract the frequency component of the received audio signal corresponding to the second audio signal from the received audio signal.

In Example 5, the subject matter of Example 4 may further include the filter being a bandpass filter.

In Example 6, the subject matter of any one of Examples 1-5 may further include the second audio signal having frequency components with frequencies higher than the frequency components of the first audio signal.

In Example 7, the subject matter of any one of Examples 1-6 may further include the second audio signal having only frequency components with frequencies higher than the frequency components of the first audio signal.

In Example 8, the subject matter of any one of Examples 1-8 may further include the second audio signal corresponding to an acoustic signal which is beyond the human hearing range.

In Example 9, the subject matter of any one of Examples 1-8 may further include the first audio signal corresponding to an acoustic signal which is within the human hearing range.

In Example 10, the subject matter of any one of Examples 1-9 may further include a controller configured to control an input power of the speaker based on the excursion.

In Example 11, the subject matter of Example 10 may further include the controller being configured to determine whether the excursion is above a predetermined threshold and to reduce an input power of the speaker if the excursion is above the predetermined threshold.

In Example 12, the subject matter of any one of Examples 1-11 may further include the frequency component of the received audio signal corresponding to the second audio signal being a frequency component of the received audio signal having the same frequency as a frequency component of the second signal.

In Example 13, the subject matter of any one of Examples 1-12 may further include the audio output device being a mobile communication device.

In Example 14, the subject matter of any one of Examples 1-13 may further include the audio output circuit being configured to supply the first audio signal and the second audio signal to the speaker by adding the first audio signal and the second audio signal and supplying the signal resulting from the addition to the speaker.

Example 15 is a method for determining a speaker cone excursion as illustrated in FIG. 2.

In Example 16, the subject matter of Example 15 may further include determining the phase of the frequency component of the received audio signal corresponding to the second audio signal by means of a phase modulation demodulator.

In Example 17, the subject matter of any one of Examples 15-16 may further include determining the excursion based on the phase by comparing the phase with a reference phase when the first audio signal is equal to a predetermined signal.

In Example 18, the subject matter of any one of Examples 15-17 may further include filtering the received audio signal to extract the frequency component of the received audio signal corresponding to the second audio signal from the received audio signal.

In Example 19, the subject matter of Example 18 may further include filtering the received audio signal by means of a bandpass filter.

In Example 20, the subject matter of any one of Examples 15-19 may further include the second audio signal having frequency components with frequencies higher than the frequency components of the first audio signal.

In Example 21, the subject matter of any one of Examples 15-20 may further include the second audio signal having only frequency components with frequencies higher than the frequency components of the first audio signal.

In Example 22, the subject matter of any one of Examples 15-21 may further include the second audio signal corresponding to an acoustic signal which is beyond the human hearing range.

In Example 23, the subject matter of any one of Examples 15-22 may further include the first audio signal corresponding to an acoustic signal which is within the human hearing range.

In Example 24, the subject matter of any one of Examples 15-23 may further include controlling an input power of the speaker based on the excursion.

In Example 25, the subject matter of Example 24 may further include determining whether the excursion is above a predetermined threshold and reducing an input power of the speaker if the excursion is above the predetermined threshold.

In Example 26, the subject matter of any one of Examples 15-25 may further include the frequency component of the received audio signal corresponding to the second audio signal being a frequency component of the received audio signal having the same frequency as a frequency component of the second signal.

In Example 27, the subject matter of any one of Examples 15-26 may be performed by a mobile communication device.

In Example 28, the subject matter of any one of Examples 15-27 may further include supplying the first audio signal and the second audio signal to the speaker by adding the first audio signal and the second audio signal and supplying the signal resulting from the addition to the speaker.

Example 29 is a computer readable medium having recorded instructions thereon which, when executed by a processor, make the processor perform a method for determining a speaker cone excursion according to any one of Examples 15 to 28.

Example 30 is an audio output device comprising a speaker; an audio outputting means for receiving a first audio signal to be output and for supplying the first audio signal and a second audio signal to the speaker, wherein the second audio signal has a higher frequency than the first audio signal; a microphone for receiving an acoustic signal from the speaker in response to the first audio signal and the second audio signal and to convert the acoustic signal into a received audio signal; and a determining means for determining a phase of a frequency component of the received audio signal corresponding to the second audio signal and to determine an excursion of the speaker by the first audio signal based on the phase.

In Example 31, the subject matter of Example 30 may further include the determining means comprising a phase modulation demodulator for determining the phase of the frequency component of the received audio signal corresponding to the second audio signal.

In Example 32, the subject matter of Example 30 may further include the determining means being for determining the excursion based on the phase by comparing the phase with a reference phase when the first audio signal is equal to a predetermined signal.

In Example 33, the subject matter of any one of Examples 30-32 may further include, the determining means comprising a filter for filtering the received audio signal to extract the frequency component of the received audio signal corresponding to the second audio signal from the received audio signal.

In Example 34, the subject matter of Example 33 may further include the filter being a bandpass filter.

In Example 35, the subject matter of any one of Examples 30-34 may further include the second audio signal having frequency components with frequencies higher than the frequency components of the first audio signal.

In Example 36, the subject matter of any one of Examples 30-35 may further include the second audio signal having only frequency components with frequencies higher than the frequency components of the first audio signal.

In Example 37, the subject matter of any one of Examples 30-36 may further include the second audio signal corresponding to an acoustic signal which is beyond the human hearing range.

In Example 38, the subject matter of any one of Examples 30-37 may further include the first audio signal corresponding to an acoustic signal which is within the human hearing range.

In Example 39, the subject matter of any one of Examples 30-38 may further include a controlling means for controlling an input power of the speaker based on the excursion.

In Example 40, the subject matter of Example 39 may further include the controlling means being for determining whether the excursion is above a predetermined threshold and for reducing an input power of the speaker if the excursion is above the predetermined threshold.

In Example 41, the subject matter of any one of Examples 30-40 may further include the frequency component of the received audio signal corresponding to the second audio signal being a frequency component of the received audio signal having the same frequency as a frequency component of the second signal.

In Example 42, the subject matter of any one of Examples 30-41 may be a mobile communication device.

In Example 43, the subject matter of any one of Examples 30-42 may further include the audio outputting means being for supplying the first audio signal and the second audio signal to the speaker by adding the first audio signal and the second audio signal and supplying the signal resulting from the addition to the speaker.

It should be noted that one or more of the features of any of the examples above may be combined with any one of the other examples.

In the following, examples are described in further detail.

Figure 3:
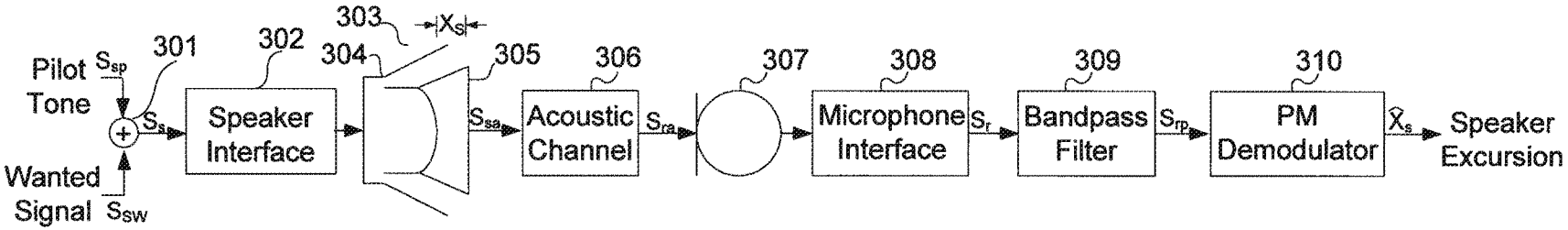
FIG. 3 shows an audio processing arrangement.

FIG. 3 shows an audio processing arrangement 300.

The audio processing arrangement 300 includes an adder 301, a speaker interface 302, a speaker 303 having a frame 304 and a cone 305, an acoustic channel 306, a microphone 307, a bandpass filter 308 and a phase modulation (PM) demodulator 310.

The adder 301, the speaker interface 302, the speaker 303, the microphone 307, the bandpass filter 308 and the PM demodulator 310 are part of an audio output device, for example of a mobile communication device such as a mobile phone. The speaker is for example a speaker of a mobile communication device such as a mobile phone, for example a speaker for hands-free talking, e.g. arranged at the back-side of the mobile phone. The microphone is for example the or one of the microphones of the mobile communication device (e.g. phone) which is used by the user to input speech. For example, the adder 301 is part of an audio output circuit of the audio output device.

It is assumed that that the audio output circuit is to output a wanted audio signal $s_{sw}$. For example, the audio output device is a telephone and the wanted audio signal is a received speech signal from another user. The wanted audio signal can also be some audio signal from an application, e.g. an audio signal of a video that the user watches.

The adder 301 is configured to superimpose a high frequency pilot tone $s_{sp}$ on the wanted audio signal $s_{sw}$. The high frequency pilot tone has a higher frequency than the wanted audio signal. This may be understood as that all frequency components of the high frequency pilot tone have frequencies that are higher than the range of frequencies included in the wanted audio signal. Since the wanted audio signal is assumed to be audible by the human user, it for example has a frequency spectrum lying within the range of 20 Hz to 20 kHz (this range may actually be smaller than that due to limitations of the speaker 303) and the pilot tone for example includes one or more frequencies above 20 kHz, e.g. between 30 kHz and 100 kHz, i.e. frequencies which are not audible. The one or more frequencies of the pilot tone may be for example chosen such that they are not audible by human ears but are still sufficiently low such that their directivity does not prevent the component or components of the audio signal as output by the speaker 303 to reach the microphone 307.

The adder 301 feeds the result of the superposition $s_s$ to the speaker 303 by means of a speaker interface 302. The signal $s_s$ causes the voice coil and the cone 305 of the loudspeaker 303 to move to a position $x_s$ and at the same time to emit an acoustic wave (i.e. acoustic signal) $s_{sa}$.

Figure 4:
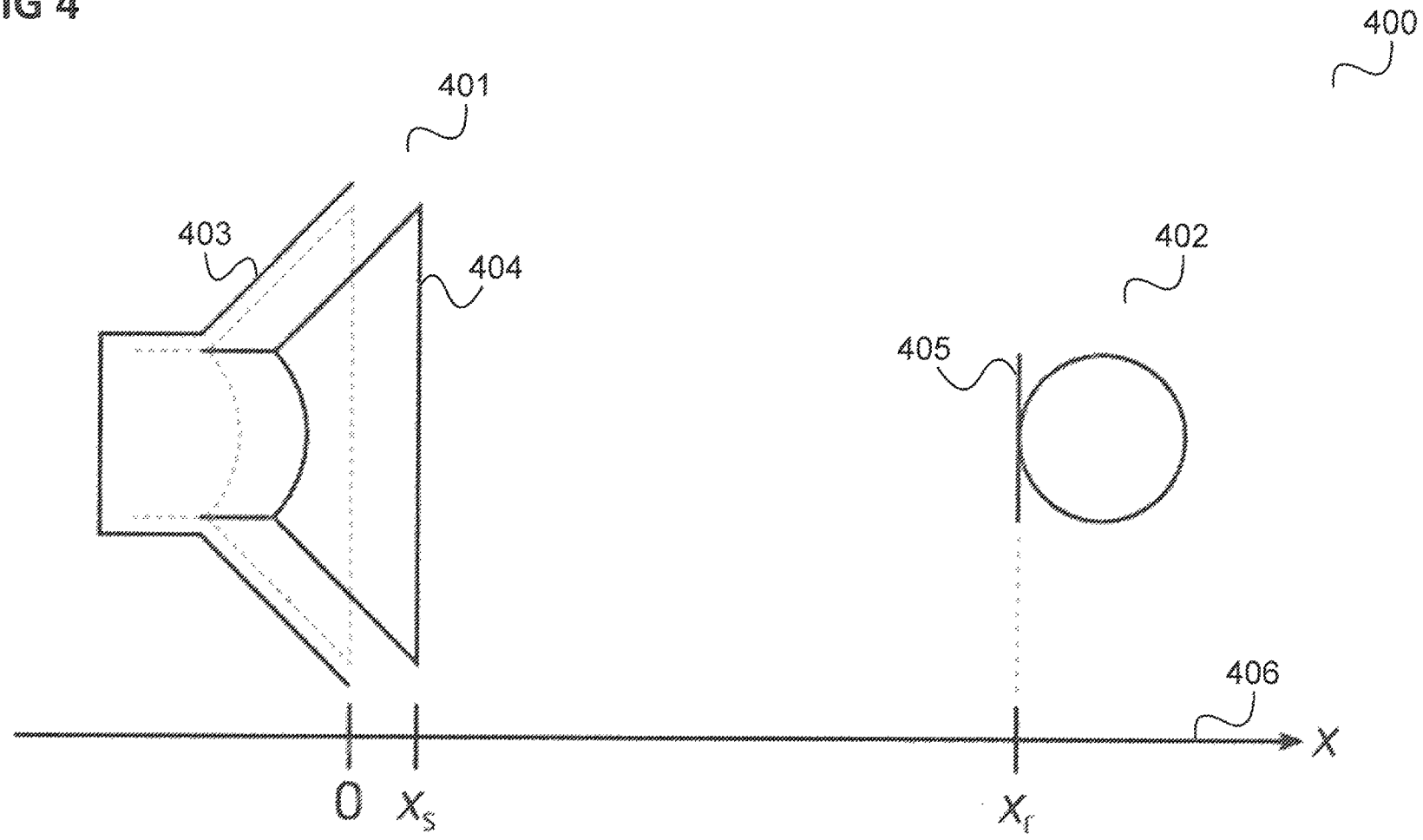
FIG. 4 shows an arrangement of a speaker and a microphone.

This is illustrated in more detail in FIG. 4.

FIG. 4 shows an arrangement 400 of a speaker 401 and a microphone 402.

The speaker 401 for example corresponds to the speaker 303 and the microphone 402 for example corresponds to the microphone 307.

The speaker 401 comprises a speaker frame 403 and a cone 404. A voice coil (not shown) is attached to the cone 404.

It is assumed that the rest position of the speaker cone 404 (i.e. the position of the speaker cone 404 when no audio signal is input to the speaker 401) is at a position $x_{s,0}=0$ and the microphone 402 (specifically the microphone membrane 405) is located at the position $x_r$ as indicated on the x-axis 406.

The signal $s_s(t_s)$ (i.e. the signal $s_s$ at time $t_s$) causes the speaker cone 404 to move to the position $x_s(t_s)$ where an acoustic wave value $s_{sa}(t_s)$ is emitted at time $t_s$.

At time $t_r>t_s$ the acoustic wave value $s_{ra}(t_r)$ is received by the microphone membrane 405 at position $x_r$. The time difference between emission and reception of the acoustic wave is determined by the wave propagation speed c and the distance between speaker 403 and microphone 402 at the time of the emission:

$$t_r = t_s + \frac{|x_r - x_s(t_s)|}{c} \tag{1}$$

Neglecting all properties of the acoustic channel except for the propagation gives $$s_{ra}(t_r)=s_{sa}(t_s) \tag{2}$$

These two equations can be seen to describe the Doppler effect caused by a moving sender in time domain.

Thus, via the acoustic channel 306, the microphone 307 receives the acoustic signal $s_{ra}$ and converts it into a received signal $s_r$ which is output by microphone interface 308.

For this example, it is assumed that the pilot tone $s_{sp}$ is a pure tone with amplitude $A_p$ and frequency $f_p$, i.e.

$$s_{sp}(t)=A_p\cdot\sin(\omega_p\cdot t) \text{ where } \omega_p=2\pi\cdot f_p \tag{3}$$

Using equation (2), one obtains the received signal $s_r$ as $$s_r(t_r)=s_{sw}(t_s)+A_p\cdot\sin(\omega_p\cdot t_s) \tag{4}$$

For using the Doppler shift on the pilot tone for speaker cone excursion determination, the bandpass filter 309 with filter coefficient vector $h_{BP}$ removes the unnecessary spectral components of the received signal. For example, in case of a pilot tone of 100 kHz, the bandpass filter 309 filters out frequencies which do not lie within a range of 70 kHz to 130 kHz. The output of the bandpass filter 309 is denoted as $s_{rp}$:

$$s_{rp}(t_r)=h_{BP}*s_r(t_r)=A_p\cdot\sin(\omega_p\cdot t_s) \tag{5}$$

To eliminate in $t_s$ equation (2), equation (1) is solved for $t_s$. Since this is not possible without simplification, the following is assumed:

1. The speaker cone 404 is located to the left of the microphone 402:

$$x_s(t_s)<x_r \tag{6}$$

2. The propagation delay is sufficiently short and the maximum voice coil velocity $$\frac{\partial x_S}{\partial t}$$

is sufficiently low such that the speaker cone excursion at the time of the emission $x_s(t_s)$ can be approximated by the excursion at the time of reception $x_s(t_r)$:

$$x_s(t_s)\approx x_s(t_r) \tag{7}$$

Thus, $$t_r \approx t_s + \frac{x_r - x_s(t_r)}{c} \tag{8}$$

$$\Rightarrow t_s \approx t_r - \frac{x_r}{c} + \frac{x_s(t_r)}{c}$$

and the received signal is:

$$s_{rp}(t_r) = A_p \cdot \sin\left(\omega_p \cdot t_r - \frac{\omega_p \cdot x_r}{c} + \frac{\omega_p}{c} \cdot x_s(t_r)\right) \tag{9}$$

Based on the term $$\frac{\omega_p}{c} \cdot x_s(t_r)$$

in the argument of the since in equation (9), the received pilot tone is interpreted as being phase-modulated by the voice coil excursion $x_s$ by a phase modulation coefficient $$k_{PM} = \frac{\omega_p}{c}.$$

The PM demodulator 310 extracts the phase modulation $$\frac{\omega_p}{c} \cdot x_s(t_r)$$

at time $t_r$ and determines an estimate for the speaker cone excursion by dividing by $k_{PM}$.

To determine the phase modulation, the PM demodulator for example first determines a reference phase of the pilot signal by outputting only the pilot tone (i.e. with the wanted signal set to zero). Thus, the PM demodulator can determine the phase modulation $$\frac{\omega_p}{c} \cdot x_s(t_r)$$

by comparison with the reference phase.

It should further be noted that in an example where the microphone is not located on the center axis of the loudspeaker but for example is located at an angle δ to the center axis of the loudspeaker this may be taken into account by including a factor of cos δ in $k_{PM}$.

While specific aspects have been described, it should be understood by those skilled in the art that various changes in form and detail may be made therein without departing from the spirit and scope of the aspects of this disclosure as defined by the appended claims. The scope is thus indicated by the appended claims and all changes which come within the meaning and range of equivalency of the claims are therefore intended to be embraced.

The invention claimed is:

1. An audio output device comprising:

a speaker;

an audio output circuit configured to receive a first audio signal and configured to supply the first audio signal and a second audio signal to the speaker, wherein the second audio signal comprises a higher frequency than the first audio signal;

a microphone configured to receive an acoustic signal from the speaker in response to the first audio signal and the second audio signal and to convert the acoustic signal into a received audio signal; and a signal processing device configured to determine a phase of a frequency component of the received audio signal corresponding to the second audio signal and to determine an excursion of the speaker by the first audio signal based on the phase wherein the audio output circuit is further configured to control an input power of the speaker based on the excursion.

2. The audio output device according to claim 1, wherein the signal processing device comprises a phase modulation demodulator configured to determine the phase of the frequency component of the received audio signal corresponding to the second audio signal.

3. The audio output device according to claim 1, wherein the signal processing device determines the excursion based on the phase by comparing the phase with a reference phase when the first audio signal is equal to a predetermined signal.

4. The audio output device according to claim 1, wherein the signal processing device comprises a filter configured to filter the received audio signal to extract the frequency component of the received audio signal corresponding to the second audio signal from the received audio signal.

5. The audio output device according to claim 4, wherein the filter is a bandpass filter.

6. The audio output device according to claim 1, wherein the second audio signal comprises frequency components with frequencies higher than the frequency components of the first audio signal.

7. The audio output device according to claim 1, wherein the second audio signal comprises only frequency components with frequencies higher than the frequency components of the first audio signal.

8. The audio output device according to claim 1, wherein the second audio signal corresponds to an acoustic signal which is beyond the human hearing range.

9. The audio output device according to claim 1, wherein the first audio signal corresponds to an acoustic signal which is within the human hearing range.

10. The audio output device according to claim 1, wherein the audio output circuit is further configured to determine whether the excursion is above a predetermined threshold and to reduce an input power of the speaker if the excursion is above the predetermined threshold.

11. The audio output device according to claim 1, wherein the frequency component of the received audio signal corresponding to the second audio signal is a frequency component of the received audio signal comprising the same frequency as a frequency component of the second signal.

12. The audio output device according to claim 1, being a mobile communication device.

13. The audio output device according to claim 1, wherein the audio output circuit is configured to supply the first audio signal and the second audio signal to the speaker by adding the first audio signal and the second audio signal and supplying the signal resulting from the addition to the speaker.

14. A method for determining a speaker cone excursion comprising:

receiving a first audio signal;

supplying the first audio signal and a second audio signal to the speaker, wherein the second audio signal comprises a higher frequency than the first audio signal;

receiving an acoustic signal from the speaker in response to the first audio signal and the second audio signal;

converting the acoustic signal into a received audio signal;

determining a phase of a frequency component of the received audio signal corresponding to the second audio signal;

determining an excursion of the speaker by the first audio signal based on the phase; and controlling an input power of the speaker based on the excursion.

15. The method according to claim 14, comprising determining the phase of the frequency component of the received audio signal corresponding to the second audio signal by means of a phase modulation demodulator.

16. The method according to claim 14, comprising determining the excursion based on the phase by comparing the phase with a reference phase when the first audio signal is equal to a predetermined signal.

17. The method according to claim 14, comprising filtering the received audio signal to extract the frequency component of the received audio signal corresponding to the second audio signal from the received audio signal.

18. The method according to claim 17, comprising filtering the received audio signal by means of a bandpass filter.

19. A non-transitory computer readable medium having recorded instructions thereon which, when executed by a processor, make the processor perform a method for determining a speaker cone excursion according to claim 14.

* * * * *